US006096463A

United States Patent [19]

Hamano et al.

[11] Patent Number: 6,096,463

[45] Date of Patent: Aug. 1, 2000

[54] IMAGE FORMING METHOD

[75] Inventors: Hirokazu Hamano; Yutaka Sugizaki, both of Minamiashigara, Japan

[73] Assignee: Fuji Xerox Co., Ltd., Tokyo, Japan

[21] Appl. No.: 09/386,342

[22] Filed: Aug. 31, 1999

[30] Foreign Application Priority Data

Sep. 22, 1998 [JP] Japan ..... 10-268181

[51] Int. Cl.[7] ..... G03G 13/01; G03G 13/20

[52] U.S. Cl. ..... 430/47; 430/111; 430/124

[58] Field of Search ..... 430/47, 111, 124

[56] References Cited

U.S. PATENT DOCUMENTS

| | | | |
|---|---|---|---|
| 5,470,687 | 11/1995 | Mayama et al. | 430/111 |
| 5,776,646 | 7/1998 | Hagi et al. | 430/111 |
| 5,827,632 | 10/1998 | Inaba et al. | 430/111 |
| 5,981,132 | 11/1999 | Kurose et al. | 430/111 |

FOREIGN PATENT DOCUMENTS

| | | |
|---|---|---|
| 4-242752 | 8/1992 | Japan . |
| 5-150679 | 6/1993 | Japan . |
| 9-171313 | 6/1997 | Japan . |
| 9-329980 | 12/1997 | Japan . |
| 10-10895 | 1/1998 | Japan . |

*Primary Examiner*—Roland Martin
*Attorney, Agent, or Firm*—Oliff & Berridge, PLC

[57] ABSTRACT

An image forming method including developing an electrostatic latent image formed on an electrostatic latent image carrier with a toner containing colored particles comprised of at least a binder resin and a coloring agent to form a toner image, transferring the toner image to a transfer material to form a transferred image, and fixing the transferred image on the transfer material, wherein the toner is made up of at least a binder resin and colored particles containing a coloring agent, the volume mean particle size of the colored particles is from 2.0 to 5.0 $\mu$m, the colored particles of 1.0 $\mu$m or smaller are 20 number % or lower, and the colored particles of 5.0 $\mu$m or larger are 10 number % or lower. The image forming method has a high reproducibility of fine lines and forms an image of a high quality without forming uneven gloss in the image and between the image area and the non-image area and without causing problems such as offset and paper clogging.

19 Claims, 4 Drawing Sheets

IMAGE FORMING METHOD

FIELD OF THE INVENTION

The present invention relates to an image forming method used for an electrophotographic method, an electrostatic recording method, an electrostatic printing method, etc., and particularly to an image forming method using a contact-type fixing apparatus suitable for forming full-color images.

BACKGROUND OF THE INVENTION

In an electrophotographic method, a toner in a developer is stuck to electrostatic latent images formed on a photoreceptor to form a toner image and after transferring the toner image onto a transfer material, the toner image is fixed by heating to form an image.

On the other hand, in the printer and copying machine using an electrophotographic method, color printing has been progressed and from the improvement of the resolving power of the apparatus, the electrostatic latent images have become minute. Particularly, in a full-color copying machine of performing the development-transfer-fixing of digital latent images with color toners, a high image quality to some extent has been attained by employing color toners having small particle sizes of from 7 to 8 $\mu$m.

In these printers and copying machines, as a method of fixing unfixed toner images attached to the surface of a transfer material, there are a contact fixing system such as a pressure fixing system using only a pressure roll at normal temperature, a hot roll system using a heat roll (hereinafter, is referred to as "a contact heating-type fixings system"), etc., and a non-contact fixing system such as an oven fixing system, a flash fixing system, an electromagnetic wave fixing system, a solvent fixing system, etc.

In the contact fixing systems, the contact heating-type fixing system has been widely used at present because the system has a good heat efficiency, is relatively compact, is liable to control temperature, and has a high reliability.

The contact heating-type fixing system has been the mainstream in full-color copying machines and in this case, the material constructions of the heating roll and the press roll used for heat fixing, the fixing nip structure, etc., determine the characteristics of images, such as the coloring property and the image gloss of full-color images, the expansion of images, etc., and the releasing property of transfer materials from rolls at fixing.

For fixing images, it becomes necessary to sufficiently melt toners on a transfer material. To ensure the releasing property of a transfer material from a heating roll which is brought into contact with molten toners on the transfer material, it is frequently performed to supply a large amount of a silicone oil onto the surface of the heating roll. However, in this case, there occurs a problem that after fixing, writing onto the transfer material with a pencil, a ball pen, etc., becomes difficult. To solve such a problem, a so-called oilless fixing roll system of reducing the supplying amount of the silicone oil or not using the silicone oil has been investigated. However, because in these systems, the releasing property is gradually lowered with the increase of the number of prints, an increased improvement of the durability until the generation of an offset phenomenon has been desired.

Now, in a full-color copying machine, in the toners of cyan, magenta, and yellow, by overlapping a single color, two colors, or three colors, a full-color image is formed. Accordingly, because the toner amount of even each single color in the image area ratio 100% of a toner image formed on a toner transfer material (hereinafter, referred to as "transferred image") is usually from about 0.6 to 0.9 mg/cm$^2$, in the image of a process black formed by overlapping toner images of three colors, the toner amount becomes from 1.8 to 2.7 mg/cm$^2$, and the thickness of the unfixed toner images on the transfer material is liable to become very large. Because in the site of the process black having such a large image thickness, the pressure applied to the transferred image at fixing by a heating roll becomes large and the toners become liable to be melted as compared with a site having a relatively small image thickness, such as a single-color image, etc., the image gloss becomes high and the site having a high image gloss and the site having a low image gloss are intermixed in the same image, whereby it sometime happens that visual quality feeling is largely lowered. To prevent the occurrence of the phenomenon, an attempt of improving the following property of the heating roll to the transferred image by forming a rubber layer having a low hardness on the surface of the heating roll has been made but lowering of the image quality by the difference of the extents of the image gloss as described above has not yet been completely solved.

Furthermore, because in the portion having such a large image thickness, toners are liable to be melted as described above, there is a problem that an offset of the toners is liable to form to the heating roll; because of the large image thickness, there are problems that the ratio of extending toners to the lateral direction at fixing becomes large, and when an image containing fine lines is fixed, the fine lines become thick to lower the resolution; and because the image thickness after fixing also becomes large, there is a problem that when an external force is applied, the image is liable to be damaged and thus the durability of the image is low.

SUMMARY OF THE INVENTION

The present invention has been made for solving the above-described problems and an object of this invention to provide an image forming method having a high reproducibility of fine lines and capable of forming a high-quality image having no uneven gloss between image areas and in the image areas. Also, another object of this invention is to provide an image forming method of increasing the releasing property of unfixed toner images from a fixing member, causing no problems of an off set phenomenon, paper clogging, etc., and capable of forming a high-quality image with a high stability.

That is, according to an aspect of the present invention, there is provided an image forming method comprising a development step of developing an electrostatic latent image formed on an electrostatic latent image carrier with a toner containing colored particles comprised of at least a binder resin and a coloring agent to form a toner image, a transfer step of transferring said toner image to a transfer material to form a transferred image, and a fixing step of fixing the transferred image on the transfer material, wherein in the above-described fixing step, the toner amount in the image region of the image area ratio 100% of the transferred image is 0.40 mg/cm$^2$ or less and the transferred image is fixed using a contact-type fixing apparatus.

Also, according to other aspect of this invention, there is provided an image forming method, wherein in the above-described fixing step, when the above-described transferred image is the transferred image of a process black formed by three kinds of toners of cyan, magenta, and yellow, the toner amount in the image region of the image area ratio 100% of the image of process black is 1.20 Mg/cm$^2$ or less and the transferred image is fixed using a contact-type fixing apparatus.

In this invention, the toner has preferably a small p article size and it is preferred to use a toner wherein the volume mean particle size of the above-described colored particles is from 1.0 to 5.0 $\mu$m, the colored particles having particle sizes of 1.0 $\mu$m or smaller are 20 number % or less, and the colored particles having particle sizes of 5.$\mu$m or larger are 10 number % or less.

Also, in this invention, when the above-described coloring agent is pigment particles and when the concentration of the pigment particles in the colored particles is C (weight %), the true specific gravity of the colored particles is a (g/cm$^3$), and the volume mean particle size of the colored particles is D ($\mu$m), it is preferred to use the toner satisfying the following formula (1);

$$25 \leqq a \cdot D \cdot C \leqq 90 \quad (1).$$

Furthermore, in this invention, it is preferred to use the toner containing an external additive, wherein (a) the external additive comprised of at least one kind of super fine particles having a primary particle mean particle size of from 30 nm to 200 nm and at least one kind of ultra-super fine particles having a primary particle mean particle size of 5 nm or larger but smaller than 30 nm and (b) the covering ratio of the external additive to the surfaces of the colored particles obtained by following formula (2) is at least 20% for both the super fine particles Fa and the ultra-super fine particles Fb and sum total of the covering ratios of the whole external additives is 100% or lower;

$$F = \sqrt{3} \cdot D \cdot \rho_t \cdot (2\pi \cdot d \cdot \rho_a)^{-1} \cdot C \times 100 \quad (2)$$

wherein F represents a covering ratio (%) represents the volume mean particle size ($\mu$m) of the colored particles, $\rho_t$ represents the true specific gravity of the colored particles, d represents the primary particle mean particle size ($\mu$m) of the external additive, $\rho_a$ represents the true specific gravity of the extern al additive, and C represents the ratio (x/y) of the weight x (g) of the external additive to the weight y (g) of the colored particles.

In addition, as the contact-type fixing apparatus in the fixing step of this invention, a roll—roll contact-type fixing apparatus and a roll-belt contact-type fixing apparatus are suitably used.

DETAILED DESCRIPTION OF THE INVENTION

Then, the image forming method of this invention is explained in detail by referring to the preferred embodiments thereof.

Figure 1:
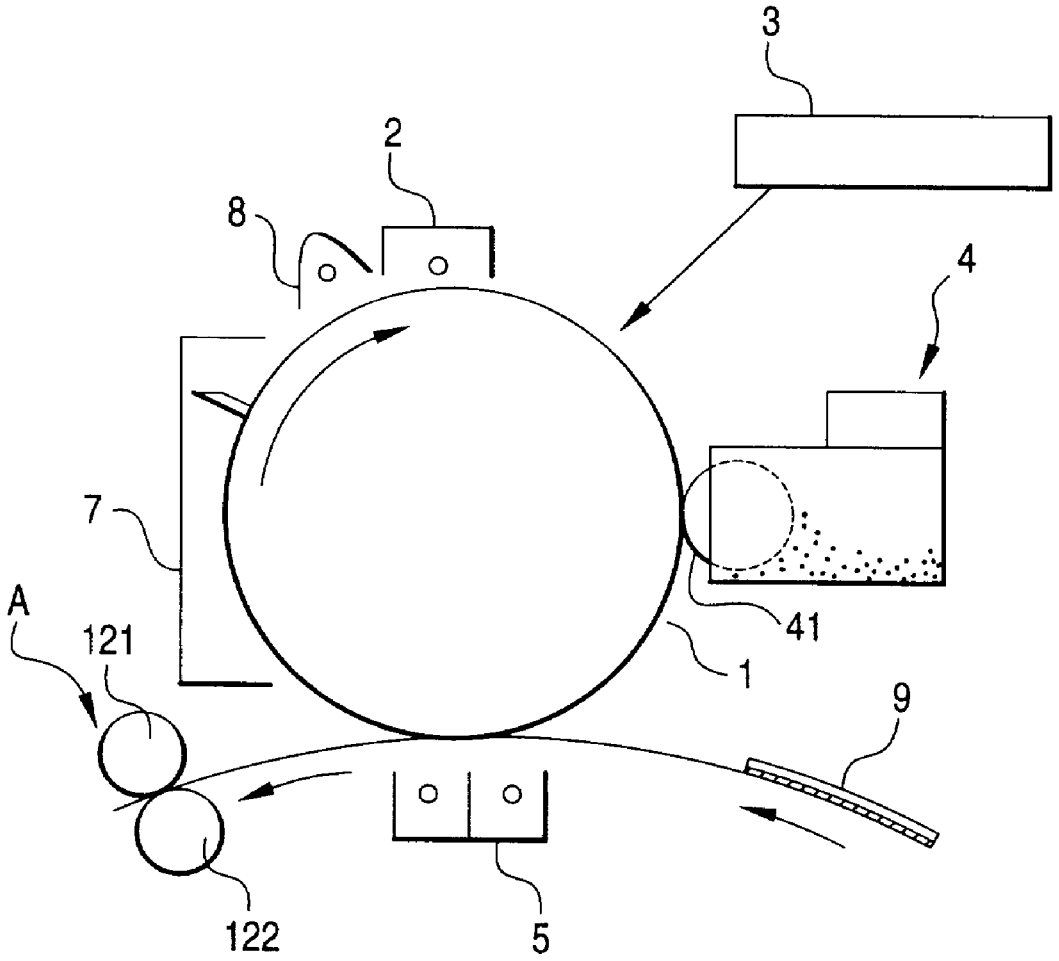
FIG. 1 is a schematic view of an embodiment of the image forming apparatus used for practicing the image forming method of this invention.

First, the image forming method of this invention is explained briefly by referring to FIG. 1. FIG. 1 is a schematic cross-sectional view showing an embodiment of the image forming apparatus utilizing the image forming method of this invention. A photoreceptor 1 is uniformly charged by a charging device 2. Then, the photoreceptor 1 is imagewise irradiated with a laser 3 to form an electrostatic latent image on the photoreceptor 1. The electrostatic latent image on the photoreceptor 1 is conveyed to the position facing a developing roll 41 contained in a developing apparatus 4 by the ration of the photoreceptor. At the position, the electrostatic latent image is developed with a toner contained in the developing apparatus to form a toner image on the photoreceptor 1. The toner image is conveyed to the position facing a transfer charging device 5 by the rotation of the photoreceptor 1 and transferred onto a transfer material. The transferred image transferred onto the transfer material is fixed to the transfer material by a contact-type fixing apparatus A composed of a heating roll 121 and a press roll 122. On the other hand, the photoreceptor 1 is brought into contact with a cleaner 7 and the toner remaining on the photoreceptor 1 is removed by the cleaner 7. Thereafter, the photoreceptor 1 is charged again by the charging device 2 and a series of image forming step is repeated.

In addition, the constitution of the image forming method of this invention is not limited to the above-described embodiment and, for example, in the image forming apparatus for full-color images, a constitution equipped with an intermediate transfer material between the photoreceptor 1 and the charging device 5 is preferred.

It is a feature of this invention to use a contact-type fixing apparatus in the fixing step. The contact-type fixing apparatus in this invention is a fixing apparatus for a type of fixing a transferred image onto a transfer material by press-contacting a fixing member such as a fixing roll, etc., to a transfer material having formed thereon a transferred toner image. In this invention, conventionally known contact-type fixing apparatus can be widely used. As the press-contact method, there are a method of passing the transfer material having formed thereon a transferred image between two contact rolls or a roll and a belt which are contacted with each other and fixing by press-contacting the transferred image at the nip region of roll—roll or roll-belt, etc.

Figure 2:
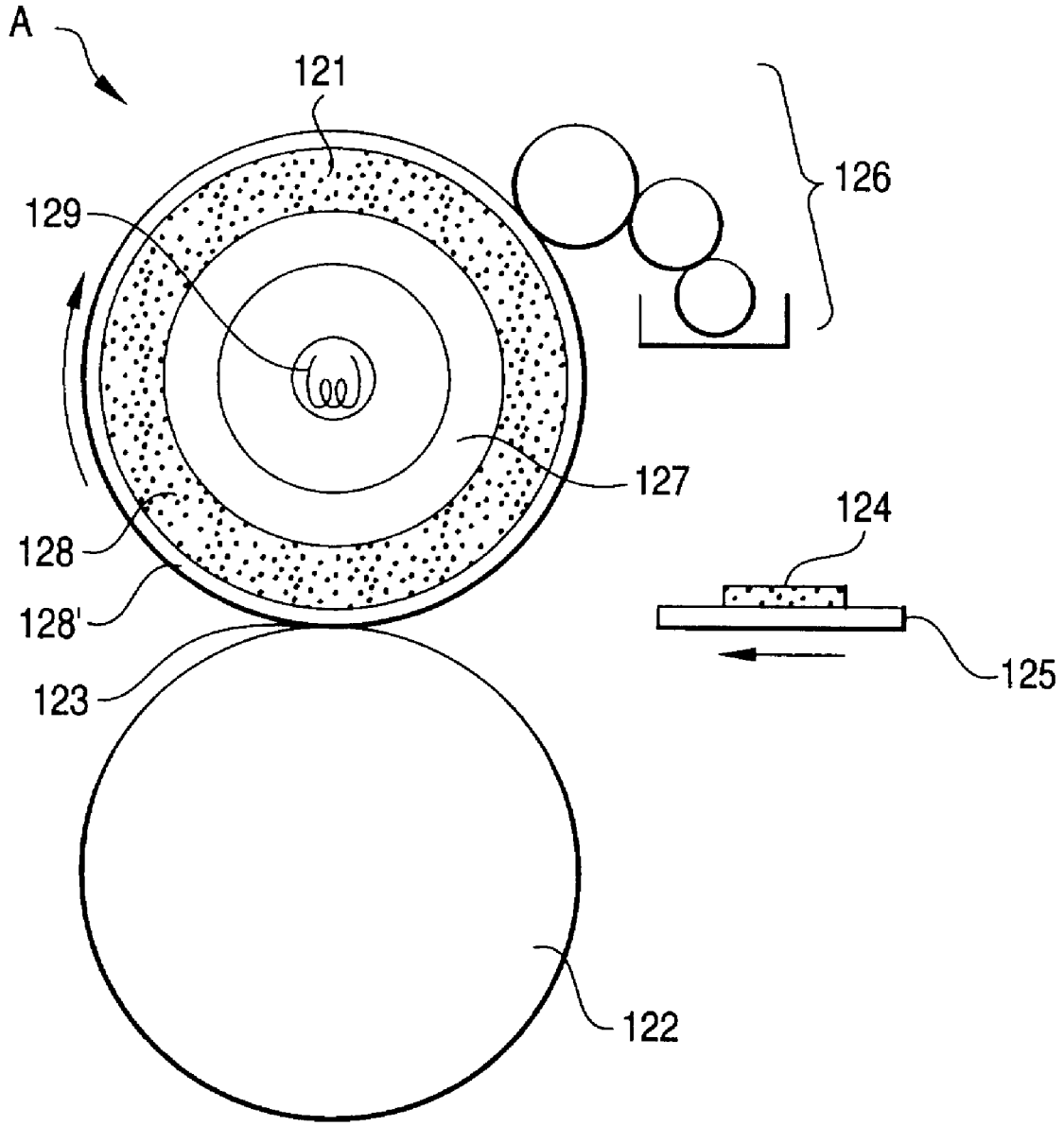
FIG. 2 is a schematic view of an embodiment of the roll—roll contact-type fixing apparatus used in the image forming method of this invention.

FIG. 2 is a schematic side view of an embodiment of a roll—roll contact-type fixing apparatus suitably used for the fixing step of this invention.

As shown in FIG. 2, in a fixing apparatus A, a heating roll 121 which is rotatably supported and a press roll 122 which is rotatably supported and is supported such that the roll is brought into press-contact with the heating roll 121 are formed. Into a nip region 123 formed between a pair of the fixing rolls is introduced a transfer material 125 having formed thereon a unfixed transferred image 124 in such a manner that the transferred image 124 faces the heating roll 123 side. When the transfer material 125 is introduced into the nip region 123, the heating roll 121 and the press roll 122 are press-contacted with the transfer material 125 from vertical opposite directions to fix the transferred image 124 onto the transfer material 125. By rotating the heating roll 121 and the press roll 122 to the opposite directions to each other, the transfer material 121 is conveyed to the direction indicated by the solid line arrow and at the outlet of the nip region 123, the transfer material 125 is released from the heating roll 121 and the press roll 122 by the self-stripping property thereof. The fixing apparatus A is equipped with an oil-supplying member 126 and the releasing property of the transfer material from the heating roll 121 is improved.

A releasing craw, which is brought into contact with the transfer material at the nip outlet, may be formed to the heating roll 121 and/or the press roll 122 to assist releasing of the transfer material from the heating roll, etc.

The heating roll 121 contains therein a core metal roll 127 made up of a metal having a high heat conductivity, such as aluminum, etc., and at least the surface thereof is made up of a rubber elastic body 128. As the rubber elastic body 128, a material having a high heat resistance and a high releasing property is preferred and, for example, a silicone rubber and a fluorine-base rubber are preferred. Also, as shown in FIG. 2, the surface of the heating roll 121 may be covered with a rubber elastic body 128' having a higher releasing property.

In the inside of the heating roll is formed a heating source 129 such as a halogen lamp, etc., by the heat supplied from the heating source, a part of the unfixed toner on the transfer material is melted and permeated in the transfer material, and press-contacting it, the transferred image is fixed onto the transfer material. On the other hand, the press-roll also contains therein a core metal roll (not shown) made up of a metal having a high heat conductivity, such as aluminum, etc., and at least the surface thereof is made up of a rubber elastic body (not shown). If desired, a heating source may be formed in the inside of the press-roll 122.

In this invention, by fixing using a so-called soft roll, that is a roll the surface of which is made up of a rubber elastic body having a relatively soft property, after melting the toner in the transferred image at fixing, the diffusion of the molten toner to the lateral direction (the vertical direction to the conveying direction of the transfer material) can be restrained. Accordingly, lowering of the reproducibility of fine lines and fine dots by extending of the molten toner on the transfer material at fixing can be effectively prevented.

Furthermore, by fixing with a soft roll, the occurrence of uneven gloss in the fixed image can be prevented.

In particular, when the hardness A of the surface of the heating roll and the hardness B of the surface of the press-roll satisfy the relation of the following formula (3), the releasing property of the transfer material by the self-stripping property is preferably improved.

$$A \leqq B \tag{3}$$

The preferred range of the hardness A of the surface of the heating roll depends on the fixing speed and the preferred range of the heat roll surface in, for example, a fixing speed of from 60 mm/sec to 200 mm/sec is 30 degree or higher and 55 degree or lower, and more preferably 35 degree or higher and 60 degree or lower. Under the same fixing speed condition, the preferred range of the hardness B is 30 degree or higher and 60 degree or lower and the hardness B may be selected according to the hardness A so that the relation of the formula (3) is obtained. When the hardness A is the same as the hardness B, it is preferred that the rubber thickness of A is thicker than the rubber thickness of B. When the difference between the hardness A and the hardness B is excessively large, an image disturbance sometimes occurs at fixing.

To simplify the explanation, the contact-type fixing apparatus was explained using FIG. 2 but the construction of the roll—roll contact-type fixing apparatus used in this invention is not limited to the fixing apparatus of the construction shown in FIG. 2 but conventionally known roll—roll contact-type fixing apparatus can be widely used. For example, the fixing apparatus proposed in JP-A-9-171313 and JP-A-10-10895 (the term "JP-A" as used herein means an "unexamined published Japanese patent application") can be suitably used in this invention.

Figure 3:
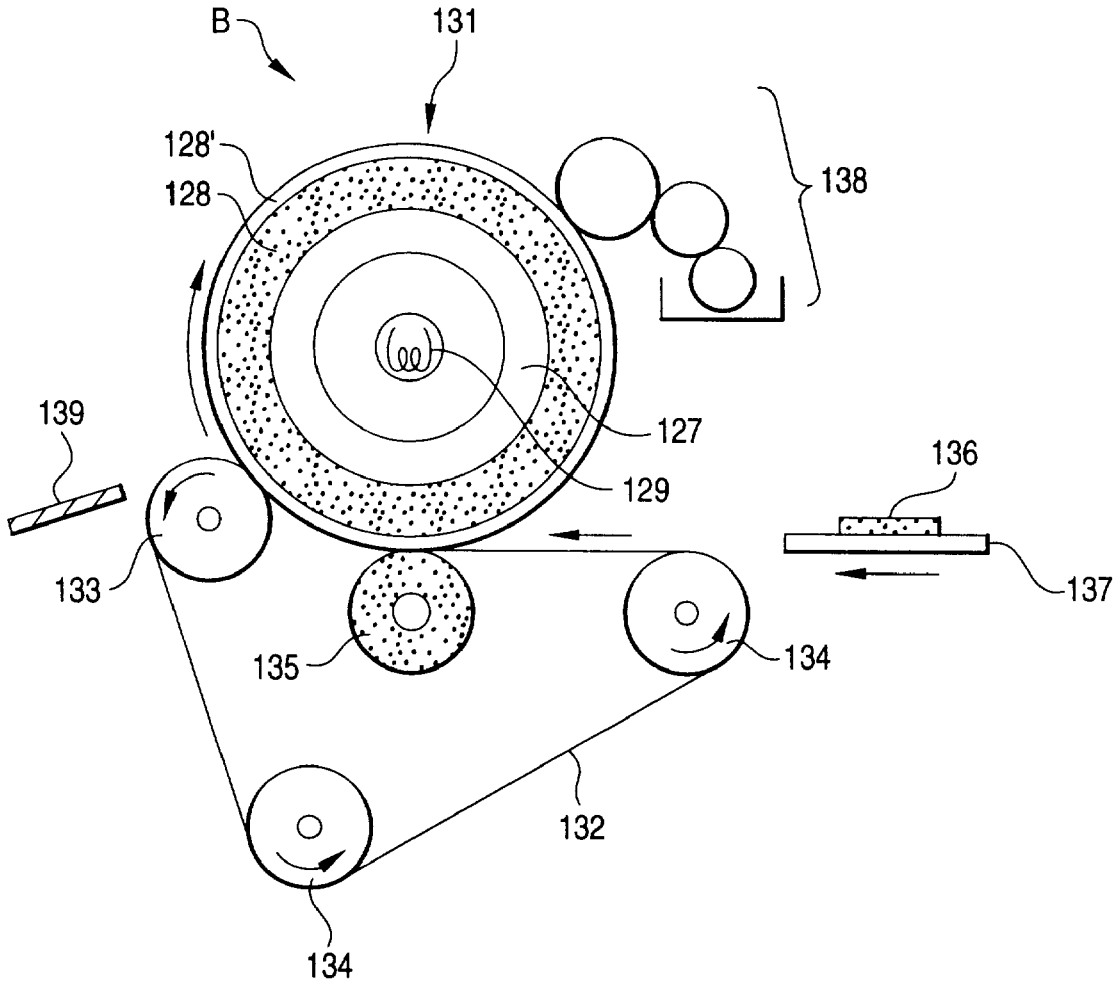
FIG. 3 is a schematic view of an embodiment of the roll-belt contact-type fixing apparatus used in the image forming method of this invention.
Figure 4:
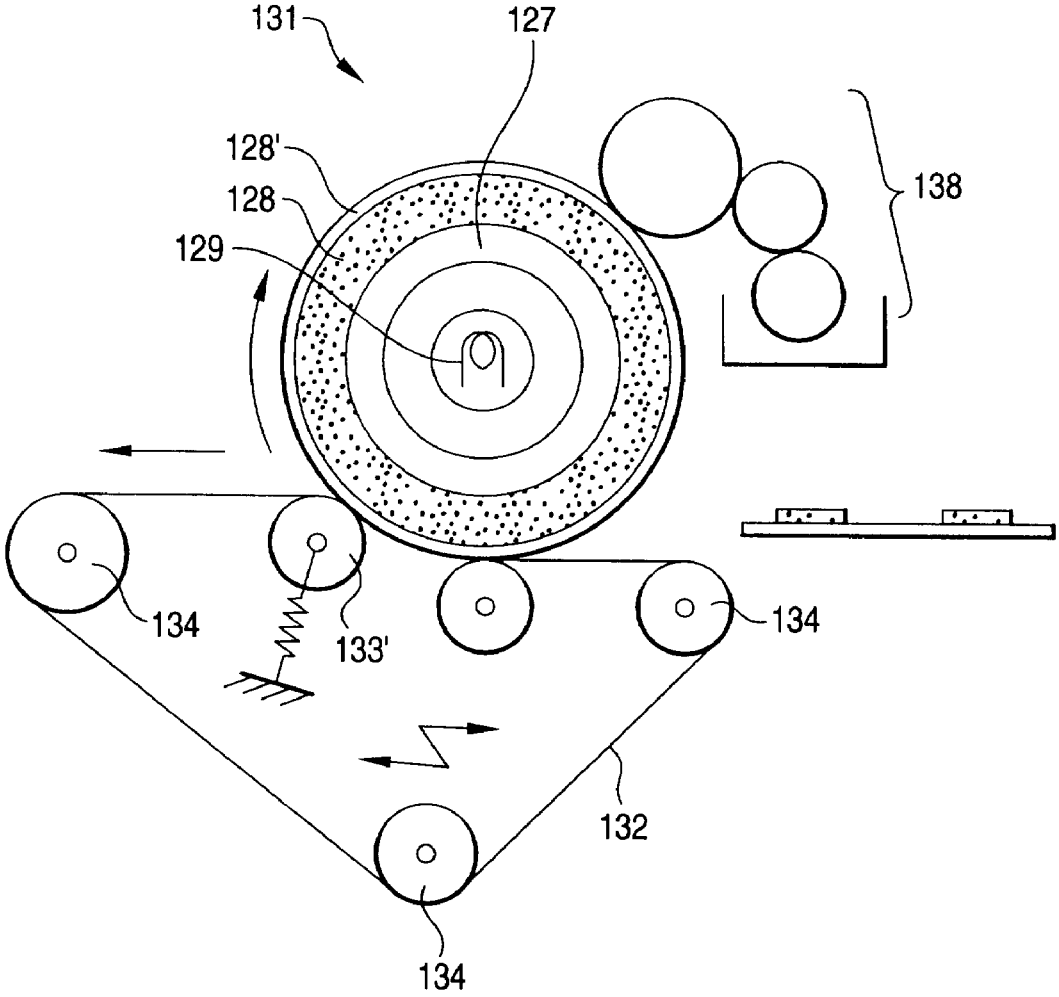
FIG. 4 is a schematic view of another embodiment of the roll-belt contact-type fixing apparatus used in the image forming method of this invention.

FIG. 3 and FIG. 4 each is a schematic side view of an embodiment of a roll-belt contact-type fixing apparatus suitably used for the fixing step of this invention.

As shown in FIG. 3, in the fixing apparatus B, a heating roll 131 rotatably supported and an endless belt 132 are provided. The endless belt 132 is mounted on driving rolls 134, 135 each rotatably supported and a press-roll 133 rotatably supported. The endless belt 132 is press-contacted with the heating roll 131 by the press-roll 133 and also is disposed such that a nip region of a definite nip width is constituted by a sponge roll 135 rotatably supported.

There are no particular restrictions on the mounting system of the endless belt and the forming method of the nip region by the heating roll and the endless belt, and the endless belt may be wound round (contact with) the heating roll at a definite angle. For example, as the fixing apparatus C shown in FIG. 4, a press-roll 133' may be formed at the nip outlet to form a nip region. Also, there is no restriction on the number of driving rolls for mounting the endless belt, but to improve the fixing efficiency by increasing the fixing speed, it is preferred to use many driving rolls.

The preferred range of the nip width formed by the heating roll and the endless belt varies according to the fixing speed and the size of the heating roll and when, for example, the fixing speed is in the range of from 60 mm/second to 200 mm/second, the nip width is preferably from about 10 mm to 25 mm because in this case, fixing can be efficiently carried out with a low energy without causing image disturbance.

As shown in FIG. 3, when a transfer material 137 having formed thereon a unfixed transferred image 136 is introduced into the nip region formed by the heating roll 131 and the endless belt 132 such that the transferred toner image 136 faces the heating roll 131 side, the transferred image 136 on the transfer material 137 is fixed onto the transfer material 137 in the nip region by the heat and the pressure supplied by the heating roll 131. By the rotation of the heating roll 131 and the rotation of the driving rolls 134 supporting the endless belt 132, the transfer material is conveyed to the solid line arrow direction and at the outlet of the nip region, the transfer material 137 is released from the heating roll 131 and the endless belt 132 by the self-stripping property thereof. In each of the fixing apparatus B and the fixing apparatus C, an oil-supplying member 138 is formed and an oil is supplied to the heating roll 131 to improve the releasing property of the transfer material from the heating roll 131.

A releasing craw (139 in FIG. 3), which is brought into contact with the transfer material at the nip outlet, may be formed to the heating roll 131 and/or the press roll 132 to assist releasing of the transfer material from the heating roll, etc. Also, a cooling means can be formed at the nip outlet to more improve the releasing property of the transfer material.

There is no particular restriction on the material of the endless belt and, for example, there are films of high molecular materials, metal materials, ceramic materials, glass fiber materials, etc., and composite materials obtained by combining two or more kinds of the above-described materials. An endless belt formed from the above-described material can be used as it is but it is preferred to further form an elastic layer having a high-heat resistance and a high-abrasion resistance on the belt. As such an elastic layer, for example, the layer of a rubber elastic body such as a fluorine-base rubber, a silicone rubber, etc., is preferred. The construction of the heating roll may be the construction same as the heating roll of the roll—roll contact-type fixing apparatus described above.

By fixing the unfixed transferred image using the roll-belt contact-type fixing apparatus having a broad nip width as described above, the transferred image can be stably fixed even by a relatively low fixing pressure and also after melting the toner in the transferred image at fixing, the diffusion of the molten toner to the lateral direction can be restrained. Accordingly, lowering of the reproducibility of fine lines and fine dots by extending of the molten toner on the transfer material at fixing can be effectively prevented.

To simplify the explanation, the contact-type fixing apparatus was explained using FIG. 3 and FIG. 4, but the construction of the roll-belt contact-type fixing apparatus used in this invention is not limited to the fixing apparatus of the construction shown in FIG. 3 and FIG. 4 but conventionally known roll-belt contact-type fixing apparatus can be widely used. For example, the fixing apparatus proposed by JP-A-5-150679 and JP-A-9-329980 are suitably used.

Also, for the image forming method of this invention, other contact-type fixing apparatus such as, for example, a belt-belt contact-type fixing apparatus can be used.

In the present invention, by lowering the toner amount of the transferred image, the diffusion of the molten toner to the lateral direction of images (the vertical direction to the conveying direction of the transfer material) by excessive melting of the toner caused at fixing by contact heating, the occurrence of the uneven gloss of images, and the occurrence of the offset phenomenon of toner to the fixing roll, are prevented. Furthermore, by limiting the particle size of the toner used to a definite range and by making the particle size distribution a proper range, the reproducibility of fine lines and fine dots, the gradation and the graininess can be improved.

In the fixing step of this invention, the toner amount (hereinafter sometimes referred to as "TMA") of the transferred image formed on a transfer material is 0.40 mg/cm$^2$ or lower, preferably 0.35 mg/cm$^2$ or lower, and more preferably 0.30 mg/cm$^2$ or lower per single color (the case of forming the image of an area ratio of 100%). When TMA is 0.40 mg/cm$^2$ or lower, the quality of the image obtained is improved and the releasing property of the transfer material to the heating roll is improved as described above, whereby the troubles such as the offset phenomenon caused by sticking the toner to the heating roll, paper clogging caused by following the heating roll of toner do not preferably occur.

However, to ensure sufficient coloring of the toners of the image obtained, TMA in the image area ratio 100% is preferably 0.1 mg/cm$^2$ or higher, and more preferably 0.15 mg/cm$^2$ or higher.

In the case of forming a full-color image, usually using three kinds (e.g., cyan, magenta, and yellow) of toners each having a different hue and a black toner, the image is formed. In the image forming method of this invention, when the transferred image formed on a transfer material is a transferred image of a tertiary color (so-called process black) formed by overlapping plural toners each having a different hue, the image is formed such that TMA thereof becomes 1.20 mg/cm$^2$ (the case of forming an image of the image area ratio of 100%) or lower. TMA is preferably 1.05 mg/cm$^2$, and more preferably 0.90 mg/cm$^2$ or lower.

In a full-color image, to ensure sufficient coloring, TMA is preferably 0.3 mg/cm$^2$ or higher, and more preferably 0.45 mg/cm$^2$ or higher.

The toner used in this invention is comprised of at least a binder resin and colored particles containing a coloring agent. The toner used has preferably small particle sizes because in this case, the reproducibility of fine lines and fine dots of images and the gradation of images are improved. Then, preferred embodiments of the toners used in the image forming method of this invention are explained.

Particle size and particle size distribution of colored particles:

In the colored particles, to achieve the improvements of the reproducibility of fine lines and the gradation, it is preferred that the volume mean particle size thereof is in the range of from 1.0 to 5.0 $\mu$m. The volume mean particle size of the colored particles is more preferably in the range of from 2.0 to 5.0 $\mu$m, far more preferably in the range of from 2.0 to 4.5 $\mu$m, still far more preferably in the range of from 2.0 to 4.0 $\mu$m, and particularly preferably in the range of from 2.5 to 3.5 $\mu$m. When the volume mean particle size of the colored particles is 5.0 $\mu$m or lower, because the ratio of coarse particles is small, the reproducibility of fine lines and fine dots of images and the gradation of images are improved. On the other hand, when the volume mean particle size of the colored particles is smaller than 1.0 $\mu$m, various troubles in other steps accompanied by lowering the powder characteristics, such as the deteriorations of the powder fluidity, the developing property, and the transfer property of the toner made up of such colored particles, lowering of the cleaning property of the toner remaining on the surface of the electrostatic latent image carrier, etc., sometimes occur. Thus, the above-described range of the volume mean particle size is preferred.

In addition, the term "reproducibility of fine lines" as used in this invention means whether or not fine lines of the width of mainly from 30 to 60 μm, and preferably from 30 to 40 μm can be faithfully reproduced and further whether or not the fine dots of about the same diameters as above can be reproduced is taken into consideration.

Furthermore, in this invention, the color particles showing the particle size distribution whose the particle sizes of 1.0 μm or smaller are 20 number % or lower and the colored particles having the particle sizes of 5 μm or larger are 10 number % or lower are preferred. If in the whole colored particles, the colored particles having the particle sizes of 1.0 μm or smaller exceeds 20 number %, fog on non-image area is liable to form and inferior cleaning of the photoreceptor is also liable to occur. Also, if the colored particles having the particle size of 1 μm exceed 20 number %, the non-electrostatic sticking force of the toner is increased, whereby the toner is stuck to the surfaces of the carriers and there are tendencies that the charge-imparting faculty of the carriers to the toner is lowered and the resistance is increased, which sometimes results in lowering the quality of the image obtained. From the view points of attaining a high-quality image and keeping a high-quality image, the colored particles showing the particle size distribution that the colored particles having the particle sizes of from 1.0 μm to 2.5 μm become from 5 to 50 number % are preferred and the colored particles showing the particle size distribution whose the above-described colored particles become from 10 to 45 number % are more preferred.

Also, as the parameter of defining the large particle size side of the particle size distribution of the colored particles, the number % of the colored particles having particle sizes exceeding 5.0 μm was used in the above explanation but the standard particle size can be defined by other numerical value. Practically, when 4.0 μm is defined as a standard particle size, it is preferred that in the whole colored particles, the colored particles having particle sizes of 4.0 μm or smaller are 75 number % or higher.

The colored particles having such a particle size distribution can be produced by a conventionally known production method. For example, in the case of obtaining a grinding method, the conditions for grinding and the classification may be properly established and in the case of obtaining a polymerization method (a suspension polymerization method, an emulsion polymerization method, etc.), the granulation condition at the polymerization may be properly established.

In the grinding method, after previously mixing a binder resin, a coloring agent, and, if necessary, other additive, etc., the mixture is melt-kneaded by a kneading machine, and after cooling, the kneaded mixture is ground and classified to make the definite particle size distribution.

Hitherto, in a grinding method, when colored particles were small-sized, the problems of increase of cost by lowering the grinding property, lowering of classifying property by the deterioration of the powder characteristics, etc., sometimes occurred. In the case of producing the colored particles used in this invention by a grinding method, by properly establishing the grinding condition at grinding, the colored particles showing the particle size distribution near the above-described preferred particle size distribution range can be produced without being accompanied by broadening of the particle size distribution caused by excessive grinding. Accordingly, because it is scarcely necessary to control the particle size distribution using a classifier or even when it is necessary to control the particle size distribution, the amount of the removing colored particles is very small, the production cost can be lowered.

The particle size distribution of the colored particles can be measured by various methods. In this invention, the particle size distribution of the colored particles is the particle size distribution measured using a coal tar counter Type TA2 (manufactured by Coal Tar Co.) with the aperture diameter of 50 μm except that in only the case of measuring the number distribution of the colored particles of 1 μm or smaller, the aperture diameter is changed to 30 μm. Practically, in the case of measuring the particle size distribution of colored particles, 2 to 3 drops of a dispersion liquid (surface active agent: Triton X100, trade name. Made by Rohm & Haas co.) and a measuring sample (colored particles ) are added into an aqueous sodium chloride solution (10 g/liter) and after carrying out a dispersing treatment by a supersonic dispersing machine for one minute, the particle size distribution is measured using the above-described apparatus.

Coloring agent:

As the coloring agent contained in the colored particles, the use of pigment particles is preferred. Because pigment particles have a high coloring power and are excellent in the water resistance, the light resistance, or the solvent resistance, when pigment particles are used as the coloring agent, even when the toner amount per unit area of an image is reduced, a sufficient image density can be attained and also the water resistance, the light resistance or the solvent resistance of the image can be ensured, which are preferred in this invention.

The kinds of pigments used in this invention include carbon black, Nigrosine, graphite, C.I. Pigment Reds 48: 1, 48: 2, 48: 3, 53: 1, 57: 1, 112, 122, 5, 139, 144, 149, 166, 177, 178, and 222; C.I. Pigment Yellows 12, 14, 17, 97, 180, 188, 93, 94, 138, and 174; C.I. Pigment Orange 31; C.I. Pigment Orange 43; C.I. Pigment Blues 15: 3, 15, 15: 2, and 60; Pigment Green 7, etc. In these pigments, carbon black, C.I. Pigment Reds 48: 1, 48: 2, 48: 3, 53: 1, 57: 1, 112, 122, and 123; C.I. Pigment Yellows 12, 14, 97, 180, and 188; and C.I. Pigment Blue 15: 3 are preferred. These pigments can be used singly or as a combination of two or more kinds of them.

When the particle size of the coloring agent contained in the colored particles is reduced, the transparency of the toner is improved. For example, in the case of forming a full-color image, plural toner images each having a single color are overlapped and when the transparency of the colored particles is low, when a two-color image of red and green, etc., or a three-color image such as process black is formed, coloring of the lower layer(s) is hindered by the colored particles of the upper layer(s), whereby a good color reproduction is sometimes not obtained. By reducing the particle sizes of the coloring agents contained in the colored particles, the transparency of the toner is ensured and the occurrence of such a phenomenon can be restrained. The particle size range of the coloring agent suitable for ensuring the transparency of the toner depends on the kind of the coloring agent used, etc., but, for example, when pigment particles are used as the coloring agent, the pigment particles dispersed in a binder resin in the state that the mean particle size of the dispersed particles is 0.3 $\mu$m or smaller in a circle-equivalent diameter are preferred.

In addition, the circle-equivalent diameter of the mean particle size of the dispersed particles in the binder resin of the pigment fine particles is the value obtained by taking out a part of the colored particles, after embedding in a resin, slicing a thin piece for observation such that the dispersed state of the pigment particles in the colored particles can be observed, photographing an enlarged photograph of 15,000× magnification by a transmission-type electron microscope, measuring the area of the pigment particle by an image analyzing apparatus, and calculating the diameter of a circle corresponding to the area.

As a method of dispersing the pigment particles in the binder resin, there is a melt flashing method (JP-A-4-242752). The melt flashing method described above is one of the methods of dispersing pigment particles in a binder resin and is a method that, for a pigment-containing aqueous cake formed in a pigment producing step, water contained in the cake is replaced with a molten resin binder. According to the method, the mean particle size of the dispersed particles in the binder resin of the pigment particles can be reduced to 0.3 $\mu$m or smaller in the circle-equivalent diameter. As a result, the coloring density of the toner can be very effectively improved. By using the toner containing the pigment fine particles having such a small particle size, the transparency of the toner can be ensured and the color reproducibility becomes good. Thus, the toners can be suitably used in the case of forming a multicolor image.

In the present invention, because TMA is lowered, it is preferred to increase the content of the coloring agent in the colored particles, increase the coloring density of the colored particles per unit weight, and reduce the toner amount necessary for the development. In particular, it is preferred that the concentration C (%) of the pigment particles in the colored particles satisfies the following formula (1).

$$25 \leqq a \cdot D \cdot C \leqq 90 \quad (1)$$

wherein, D represents a volume mean particle size (unit: $\mu$m) of the colored particles and a represents a true specific gravity (unit: g/cm$^3$) of the colored particles.

If the value of a • D • C (hereinafter referred to as "aDC") is less than 25, there is a tendency that the coloring density of the toner per unit weight becomes insufficient. On the other hand, if the value of aDC exceeds 90, it sometimes happens that even when a very slight amount of the toner is scattered to a non-image area, a background stain becomes severe and also by the reinforcing effect of the pigment, the melt viscosity of the colored particles is increased to lower the fixing property.

The preferred concentration of the pigment particles in the colored particles depends upon the coloring power of the pigment particles. For example, in the case of using the pigment particles having a relatively strong coloring power, such as black, cyan, etc., it is more preferred that the upper limit of the value of aDC is 60. However, this is only a criterion and, even for pigments having the same color, the coloring power differs from each other by the difference of the chemical structure, etc., the concentration thereof may be properly established according to the kind of the pigment used.

Binder resin:

The binder resin contained in the colored particles used in this invention has a glass transition point of preferably from 50 to 80° C., and more preferably from 55 to 75° C. If the glass transition point of the binder resin is lower than 50° C., the hot shelf life thereof is lowered and if the glass transition point exceeds 80° C., the low-temperature fixing property is lowered, which are undesirable in this invention.

Also, the softening point of the binder resin is preferably from 80 to 150° C., more preferably from 90 to 150° C., and far more preferably from 100 to 140° C. If the softening point is lower than 80° C., the hot shelf life is lowered and if the softening point exceeds 150° C., the low-temperature fixing property is lowered, which are undesirable.

Furthermore, the number average molecular weight of the binder resin is preferably in the range of from $1.0\times10^3$ to $5.0\times10^4$and the weight average molecular weight thereof is preferably in the range of from $7.0\times10^3$ to $5.0\times10^5$.

As the binder resin, conventionally used resins as the binder resins for toners are used without particular restriction. As the styrene-base polymers, (meth) acrylic acid ester-base polymers, and styrene-(meth)acrylic acid ester-base polymers, the polymers obtained by polymerizing one kind or two or more kinds of monomers properly selected from styrene-base monomers, (meth)acrylic acid ester monomers, acrylic or methacrylic monomers, vinyl ether monomers, vinyl ketone monomers, N-vinyl compound monomers, etc., described below are suitably used.

Examples of the styrene-base monomer include styrene and styrene derivatives such as o-methylstyrene, ethylstyrene, p-methoxystyrene, p-phenylstyrene, 2,4-dimethylstyrene, p-n-octylstyrene, p-n-decylstyrene, p-n-dodecylstyrene, butylstyrene, etc.

Also, examples of the (meth)acrylic acid ester monomer include methyl (meth)acrylate, ethyl (meth)acrylate, propyl (meth)acrylate, butyl (meth)acrylate, isobutyl (meth) acrylate, n-octyl (meth)acrylate, dodecyl (meth)acrylate, 2-ethylhexyl (meth)acrylate, stearyl (meth)acrylate, phenyl (meth)acrylate, and dimethylaminoethyl (meth)acrylate.

Examples of other acrylic or methacrylic monomers include acrylonitrile, methacrylonitrile, glycidyl methacrylate, N-methylolacrylamide, N-methylolmethacrylamide, and 2-hydroxyethyl acrylate.

Also, examples of the vinyl ether monomer include vinyl ethers such as vinyl methyl ether, vinyl ethyl ether, vinyl isobutyl ether, etc.

Also, examples of the vinyl ketone monomer include vinyl ketones such as vinyl methyl ketone, vinyl hexyl ketone, methyl isopropenyl ketone, etc.

Furthermore, examples of the N-vinyl compound monomer include N-vinyl compounds such as N-vinylpyrrolidone, N-vinylcarbazole, N-vinylindole, etc.

In the present invention, a polyester is suitably used as the binder resin from the view point of the fixing property. As such a polyester, a polymer synthesized by the polycondensation of a polyhydric carboxylic acid and a polyhydric alcohol can be used.

As the polyhydric alcohol monomer, aliphatic alcohols such as ethylene glycol, propylene glycol, 1,3-butanediol, 1,4-butanediol, 2,3-butanediol, diethylene glycol, 1,5-pentanediol, 1,6-hexanediol, neopentyl glycol, etc.; alicyclic alcohols such as cyclohexane dimethanol, hydrogenated bisphenol, etc.; and bisphenol derivatives such as bisphenol A ethylene ox ide adduct, bisphenol A propylene oxide adduct, etc., can be used.

As the polyhydric carboxylic acid, aromatic carboxylic acids such as phthalic acid, terephthalic acid, phthalic anhydride, etc., and the acid anhydrides thereof; and saturated or unsaturated carboxylic acids such as succinic acid, adipic acid, sebacic acid, azelaic acid, dodecenylsuccinic acid, etc., and the acid anhydrides thereof., can be used.

External additive:

For the purpose of controlling the charging amount of the toner, the toner may further contain an external additive.

A material for an inorganic fine powder which can be used as the external additive includes metal oxides such as titanium oxide, tin oxide, zirconium oxide, tungsten oxide, iron oxide, silicon oxide, etc.; nitrides such as titanium nitride, etc.; titanium compounds, etc. The addition amount of the external additive is preferably from 0.05 to 10 parts by weight, and more preferably from 0.1 to 8 parts by weight per 100 parts by weight of the colored particles.

As a method of adding the above-described inorganic fine powder to the toner, a conventionally known method of placing the inorganic fine powder and the coloring agent in, for example, a Henschel mixer followed by mixing can be employed.

To improve the powder characteristics such as the powder fluidity, the powder sticking property, etc.; prevent lowering of the transfer efficiency and the charging property; and soften the environmental dependency, it is preferred to use at least one kind of super fine particles having a primary particle mean particle size of from 30 nm to 200 nm and at least one kind of ultra-super fine particles having a primary mean particle size of 5 nm or larger but smaller than 30 nm as the external additive.

The super fine particles have the functions of reducing the sticking force of the colored particles to each other or the colored particles and the photoreceptor or the carriers, and preventing lowering of the developing property, the transferring property, or the cleaning property. The mean primary particle size of the super fine particles is preferably from 30 nm to 200 nm, more preferably from 35 nm to 150 nm, and far more preferably from 35 nm to 100 nm. If the mean primary particle size exceeds 200 nm, the super fine particles are liable to be released from the toner and cannot give the effect of reducing the sticking force. On the other hand, if the particle size is smaller than 30 nm, the particles become ones acting as the ultra-super fine particles described below.

The ultra-super fine particles have the effects of improving the fluidity of the colored particles and lowering the aggregating tendency of the colored particles as well as the effect of restraining the colored particles from being heat-aggregated, and also contribute to improving the environmental stability. The mean primary particle size of the ultra-super fine particles is preferably 5 nm or larger but smaller than 30 nm, more preferably 5 nm or larger but smaller than 29 nm, and far more preferably from 10 nm to 29 nm. If it is smaller than 5 nm, the ultra-super fine particles are liable to be embedded in the surfaces of the colored particles by the stress the toner receives. On the other hand, if it is larger than 30 nm, the particles become ones acting as the above-described super fine particles. In addition, the term "primary particle size" as used in the specification of this invention means a sphere-equivalent primary particle size.

The super fine particles include fine particles comprised of metal oxides such as silicon oxide subjected to a hydrophobic treatment, titanium oxide, tin oxide, zirconium oxide, tungsten oxide, iron oxide, etc.; nitrides such as titanium nitride, etc.; and titanium compounds and the fine particles made up of silicon oxide subjected to a hydrophobic treatment are preferred. The hydrophobic treatment is carried out by treating with a hydrophobic treating agent and as the hydrophobic treating agent, chlorosilane, alkoxysilane, silazane, or silylated isocyanate can be used. Practically, there are methyltrichlorosilane, dimethyldichlorosilane, trimethylchlorosilane, methyltrimethoxysilane, dimethyldimethoxysilane, methyltriethoxysilane, dimethyldiethoxysilane, isobutyltrimethoxysilane, decyltrimethoxysilane, hexamethyldisilazane, tert-butyldimethylchlorosilane, vinyltrichlorosilane, vinyltrimethoxysilane, vinyltriethoxysilane, etc.

The ultra-super fine particles include fine particles comprised of hydrophobic titanium compounds; metal oxides such as silicon oxide, titanium oxide, tin oxide, zirconium oxide, tungsten oxide, iron oxide, etc.; and nitrides such as titanium nitride, and, in these compounds, the fine particles of titanium compounds are preferred.

Also, as the titanium compound fine particles, the reaction product of metatitanic acid and a silane compound is preferred because the reaction compound is highly hydrophobic, is hard to form aggregates because of no burning treatment, and shows a good dispersibility at external addition. Also, as the silane compound in this case, an alkylalkoxysilane compound and/or a fluoroalkylalkoxysilane compound, which shows a good charge control of the toner and can reduce the sticking property to the carriers and the photoreceptor is preferably used.

As the metatitanic acid compound which is a reaction compound of metatitanic acid and an alkylalkoxysilane compound and/or a fluoroalkylalkoxysilane compound, the compound obtained after subjecting metatitanic acid synthesized by a sulfuric acid hydrolysis reaction to a peptization treatment, by reacting the metatitanic acid as the base and the alkylalkoxysilane compound and/or the fluoroalkylalkoxysilane compound is suitably used. As the alkylalkoxysilane to be reacted with metatitanic acid, for example, methyltrimethoxysilnae, ethyltrimethoxysilane, propyltrimethoxysilane, isobutyltrimethoxysilane, n-butyltrimethoxysilane, n-hexyltrimethoxysilane, n-octyltrimethoxysilane, n-decyltrimethoxysilane, etc., can be used. Also, as the fluoroalkylalkoxysilane compound, for example, trifluoropropyltrimethoxysilane, tridecafluorooctyltrimethoxysilane, heptadecafluorodecyltrimethoxysilane, heptadecafluorodecylmethyldimethoxysilane, (tridecafluoro-1,1,2,2-tetrahydrooctyl)triethoxysilane, (3,3,3-trifluoropropyl)triethoxysilane, (heptadecafluoro-1,1,2,2-tetrahydrodecyl) triethoxysilane, 3-(heptafluorosiopropoxy) propyltriethoxysilne, etc., can be used.

By using 2 kinds of the external additives of the super fine particles and the ultra-super fine particles, the toner has the effects of both the external additives together.

However, when the whole addition amounts of the external additives are too much, the free external additives (not stuck to the colored particles) form and the photoreceptor and the surfaces of the carriers are liable to be stained with the external additives. Also, when the addition amounts of both the super fine particles and the ultra-super fine particles are less than definite amounts, the effects of adding both the particles are not obtained. Furthermore, when the amount of the super fine particles is too much, the effect of improving the powder fluidity is not obtained and when the amount of the ultra-super fine particles is too much, the effect of improving the powder sticking property is not obtained. Accordingly, it is necessary to properly control the addition amounts of the external additives.

The effects by the addition of the external additives and the fluctuation of various powder characteristics by the addition of them do not depend upon the absolute amounts of the external additives added but depend upon the covering ratio to the surfaces of the colored particles. Thus, the covering ratio of the external additives to the surfaces of the colored particles is explained.

Figure 5:
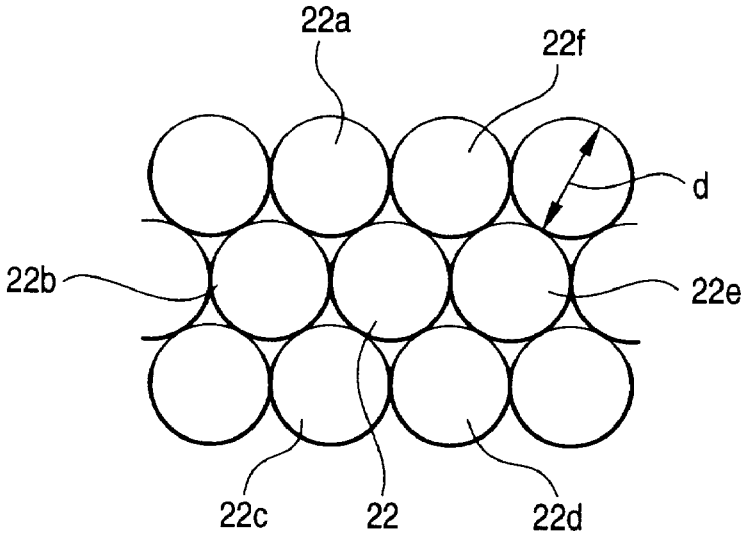
FIG. 5 is a plan view showing an enlarged part of the surface of a colored particle.

When the external additives are taken for pearls each having a definite size (diameter d) and it is assumed that primary particles without causing aggregating degree are stuck to the surface of the colored particle in a single layer, as the closest packing (the state of arranging most densely) of the external additives stuck to the surface of the colored particle is a hexagonal closest packing wherein 6 external additives 22*a* to 22*f* are adjacent to one external additive 22 as shown in FIG. 5 (FIG. 5 is enlarged plan view showing only a part of the surface of the colored particle).

When the state shown in FIG. 5 is a covering ratio of 100% as an ideal state, the ratio of the actual weight of the external additives to the actual weight of the colored particles shown by % is the covering ratio defined in this invention.

That is, when in the actual state, the volume mean particle size of the colored particles is shown by D ($\mu$m), the true specific gravity of the colored particles is $\rho_t$, the true specific gravity of the external additives is $\rho_a$, and the ratio (x/y) of the weight x (g) of the external additive to the weight y (g) of the colored particles is C, the covering ratio F (%) is shown by the following formula;

$$F=C/\{2\pi\cdot d\cdot\rho_a/(\sqrt{3}\cdot D\cdot\rho_t)\}\times 100$$

and by arranging the formula, it becomes as the following formula (2);

$$F=\sqrt{3}\cdot D\cdot\rho_t\cdot(2\pi\cdot d\cdot\rho_a)^{-1}\cdot C\times 100 \quad (2)$$

wherein F represents a covering ratio (%), D represents a volume mean particle size ($\mu$m) of the colored particles, $\rho_t$ represents a true specific gravity of the colored particles, d represents a primary particle mean particle size (gm) of the external additive, $\rho_a$ represents a true specific gravity of the external additives, and C represents a ratio (x/y) of the weight x (g) of the external additives to the weight y (g) of the colored particles.

The covering ratio of the external additives to the surfaces of the colored particles obtained by the above formula (2) is preferably at least 20% for both of the super fine particles and the ultra-super fine particles and the sum total of the covering ratios of the whole external additives is preferably 100% or lower. In addition, the term "sum total of the whole external additives" as used herein means the value obtained by calculating each covering ratio of each external additive added and summing up the covering ratios of the external additives obtained.

If the covering ratio Fa of the super fine particles is less than 20%, the effect of adding the super fine particles is not sometimes obtained. The covering ratio Fa of the super fine particles is preferably from 20 to 80%, and more preferably from 30 to 60%.

Also, if the covering ratio Fb of the ultra-super fine particles is less than 20%, the effect of adding the ultra-super fine particles is not sometimes obtained. The covering ratio Fb of the ultra-super fine particles is preferably from 20 to 80%, and more preferably from 30 to 60%.

If the sum total of the covering ratios of the whole external additives exceeds 100%, the free external additives are formed much, and the photoreceptor and the surface of the carriers are liable to be stained with the external additives. The sum total of the covering ratios of the whole external additives are preferably from 40 to 100%, and more preferably from 50 to 90%.

It is more preferred that the relation of the covering ratio Fa (%) of the super fine particles and the covering ratio Fb (%) of the ultra-super fine particles satisfies the following formula (4);

$$0.5\leqq Fb/Fa\leqq 4.0 \quad (4)$$

If the ratio is outside the range, the effects of adding the super fine particles and the ultra-super fine particles is difficult to be obtained, which is undesirable. Also, to optimize the effect of the addition of the super fine particles or the ultra-super fine particles, it is more preferred that the above-described relation satisfies the following formula (4');

$$0.5\leqq Fb/Fa\leqq 2.5 \quad (4')$$

As a method of adding the super fine particles and the ultra-super fine particles to the toner, a conventionally known method of plating the super fine particles, the ultra-super fine particles, and the colored particles in, for example, a Henschel mixer followed by mixing can be employed.

Other additives:

The toner may further contain, if necessary, a charge controlling agent, a releasing agent, etc., in the range of not giving influences on the color reproducibility and the transparency. The charge controlling agent includes chromium-base azo dyes, iron-base azo dyes, salicylic acid metal complexes, organic boron compounds, etc. Also, the releasing agent includes polyolefins such as low-molecular weight propylene, low-molecular weight polyethylene, etc.; and natural waxes such as paraffin wax, candelilla wax, carnauba wax, montan wax, etc., and the derivatives of them.

Aggregating degree of toner:

The aggregating degree of the toner is preferably 30 or lower, more preferably 25 or lower, and far more preferably 20 or lower. In this case, the aggregating degree is an index of showing the cohesive force between toners and as the value is larger, the cohesive force between toners becomes larger.

In this invention, by making the aggregating degree of the toner 30 or lower, lowering of the fluidity by short-sizing of the toner can be restrained and also the occurrences of background stains and lowering of the density caused by inferior supplying of toner, lowering of rising property of electrostatic charges, the deterioration of the charge distribution, and lowering of the charged amount can be restrained as well as the shelf life can be improved. In addition, in particular, by adding two kinds of the external additives of the super fine particles and the ultra-super fine particles as described above, by the balance of the particle sizes and the covering ratios of the external additives, the aggregating degree of the toner becomes a very low value.

The aggregating degree can be measured by using a powder tester (manufactured by Hosokawa Micron Co., Ltd.). Practically, the measurement is as follows.

Sieves each having a mesh of 45 μm, 38 μm, and 26 μm respectively were successively disposed in series in the perpendicular direction, 2 g of a toner accurately weighed was placed on the uppermost sieve of a mesh of 45 μm, a vibration of the amplitude of 1 mm was applied for 90 seconds, after the vibration, the weight of the toner on each sieve was measured, each weight was multiplied by the value of 0.5, 0.3, and 0.1, the values were added, and the value obtained was multiplied by 100. In addition, in this invention, the samples used were allowed to stand for about 24 hours under the environment of 22° C., 50% RH and the measurement was carried out under the environment of 22° C., 50% RH.

In this invention, it is preferred to mix the toner and carrier a nd use the developer of a binary system.

There is no particular restriction on the carrier, and there are magnetic substance particles such as an iron powder, ferrite, an iron oxide powder, a nickel powder, etc., resin-coated type carrier particles obtained by forming a resin-coated layer on the magnetic substance particles as the core material by coating the core material with a known resin such as a styrene-base resin, a vinyl-base resin, an ethyl-base resin, a rosin-base resin, a polyester-base resin, a methyl-base resin, etc., or a wax such as stearic acid; and magnetic substance-dispersed type carrier particles obtained by dispersing the magnetic substance particles in a binder resin, etc.

In these carriers, the resin coated-type carriers having a resin-coated layer are particularly preferred because the charging property of the toner and the resistance of the whole carriers can be controlled by the construction of the resin-coated layer.

The material for the resin-coated layer can be selected from all the resins conventionally used as the materials for the resin-coated layers of carriers in the field of the art. Also, the resins may be used singly or as a mixture of two or more kinds.

In the particle sizes of the carriers, the volume mean particle size is preferably 45 μm or smaller, and more preferably from 10 to 40 μm. By making the volume mean particle size of the carriers 45 μm or smaller, the occurrences of the background stain and the uneven density caused by the deterioration of rising of the charge and the charge distribution caused by small-sizing of the toner (colored particles) and lowering of the charged amount can be improved.

EXAMPLES

Then, the invention is explained in more detail by referring to the examples but the invention is not limited to these examples.

1. Examples of the formation of single color image:

1) Preparation example of magenta flashing pigment:

In a kneading machine were placed 70 parts by weight of a polyester resin (bisphenol A type polyester: bisphenol A ethylene oxide adduct-cyclohexanedimethanol-terephthalic acid; weight average molecular weight: 11,000; number average molecular weight: 3,500; Tg: 65° C.) and 75 parts by weight of a magenta pigment (C.I. Pigment Red 57: 1)-containing hydrous paste (pigment component 40% by weight) followed by mixing, and the mixture obtained was gradually heated. Kneading was continued at 120° C., after separating an aqueous phase from a resin phase, water was removed, the resin phase was further kneaded to remove water, and the residue was dehydrated to obtain a magenta flashing pigment.

2) Preparation of magenta-colored particles:

<Preparation Example 1 of magenta-colored particles>

Polyester resin (bisphenol A type polyester: bisphenol A ethylene oxide adduct-cyclohexane-dimethanol-terephthalic acid; weight average molecular weight: 11000; number average molecular weight: 3500; Tg: 65° C.) 67 parts by weight Above-described magenta flashing pigment (pigment component 30% by weight) 33 parts by weight.

The above components were melt-kneaded by a bambury mixer, and after cooling, fine-grinding by a jet mill and a classification by an air classifier were carried out to obtain magenta-colored particles.

3) Preparation of magenta toner:

To the above-described magenta-colored particles were added silica ($SiO_2$) fine particles of a primary particle mean particle size of 40 nm subjected to a surface hydrophobic treatment with hexamethyldisilazane (hereinafter referred to as "HMDS") and metatitanic acid fine particles of a primary particle mean particle size of 20 nm, which was the reaction product of metatitanic acid and isobutyltrimethoxysilane such that each covering ratio to the surfaces of the colored particles became 40% and they were mixed by a Henschel mixer to prepare a magenta toner.

In addition, the covering ratio to the surfaces of colored particles in this case is the value F (%) obtained by the above-described formula (2).

4) Preparation of carriers:

To 100 parts by weight of Cu-Zn ferrite fine particles having a volume mean particle size of 40 μm was added a methanol solution containing 0.1 part by weight of γ-amiopropyltriethoxysilane, after coating by a kneader, methanol was distilled off, and further the mixture was heated to 120° C. for 2 hours to completely cure the above-described silane compound. To the particles was added a solution obtained by dissolving a perfluorooctylethyl methacrylate-methyl methacrylate copolymer (copolymerization ratio 40:60), and using a vacuum-type kneader, a resin coated-type carriers were produced such that the coated amount of the perfluorooctylethyl methacrylate-methyl methacrylate copolymer became 0.5% by weight.

5) Preparation of developer:

By mixing 4 parts by weight of the magenta toner thus obtained with 100 parts by weight of the resin coated-type carriers obtained as described above, a magenta electrostatic latent image developer was prepared and was used as the developer in Example 1 shown below.

In the above-described production method of the magenta electrostatic latent image developer, by following the same procedure as above by changing the kind of the pigment particles used, the grinding and classification conditions of the colored particles, the covering ratio of the external additives, the concentration of the pigment, etc., the toners used in Example 2 to Example 12 and the toners used in Comparative Example 1 to Comparative Example 12 were prepared. In this case, however, the covering ratios of the external additives in Examples 2 to 12 were 40% as in Example 1.

The various characteristics of the toners used in Example 1 to Example 12 and the various characteristics of the toners used in Comparative Example 1 to Comparative Example 12 are shown in Table 1 and Table 2, respectively. The TMAs (the measurement conditions are described below) are also shown in Table 1 and Table 2.

In addition, in the tables, M is magenta, K is black, C is cyan, and Y is yellow. The pigment particles used for the toner of M were the same as those in Example 1 and the pigment used for the toners of K was carbon black. As the pigment particles used for the toners of C and Y, the flashing pigments produced by the following methods were used.

<Cyan flashing pigment>

By following the same procedure as the case of producing the magenta flashing pigment described above except that a cyan pigment (C.I. Pigment Blue 15: 3 )-containing hydrous paste (pigment component 40% by weight) was used in place of the magenta pigment-containing hydrous paste, a cyan flashing pigment was prepared.

<Yellow flashing pigment>

By following the same procedure as the case of producing the magenta flashing pigment described above except that a yellow pigment (C.I. Pigment Yellow 17)-containing hydrous paste (pigment component 40% by weight) was used in place of the magenta pigment-containing hydrous paste, a yellow flashing pigment was prepared.

TABLE 1

| Single color | Volume mean particle size (μm) | Particles > 5 μm (number %) | Particles < 1 μm (number %) | Particles of 1.0 to 2.5 μm (number %) | Color | Pigment concentration (%) | aDC | TMA (mg/cm$^2$) |
|---|---|---|---|---|---|---|---|---|
| Example 1 | 3.0 | 2.2 | 3.0 | 42.5 | M | 10 | 43.2 | 0.25 |
| Example 2 | 3.5 | 1.6 | 3.2 | 39.8 | K | 9 | 37.8 | 0.25 |
| Example 3 | 3.6 | 1.6 | 2.9 | 37.5 | C | 10 | 43.2 | 0.25 |
| Example 4 | 3.6 | 1.7 | 2.9 | 37.2 | Y | 12 | 51.6 | 0.25 |
| Example 5 | 4.2 | 8.1 | 2.0 | 25.1 | M | 10 | 50.4 | 0.35 |
| Example 6 | 4.1 | 7.6 | 2.1 | 23.3 | K | 9 | 44.3 | 0.35 |
| Example 7 | 4.1 | 7.8 | 2.1 | 22.9 | C | 10 | 49.2 | 0.35 |
| Example 8 | 4.2 | 8.4 | 1.7 | 24.8 | Y | 12 | 60.5 | 0.35 |
| Example 9 | 3.5 | 2.4 | 3.1 | 39.9 | M | 8 | 33.6 | 0.25 |
| Example 10 | 3.4 | 2.0 | 3.3 | 40.1 | K | 7 | 28.6 | 0.25 |
| Example 11 | 3.3 | 1.8 | 3.6 | 42.1 | C | 8 | 31.7 | 0.25 |
| Example 12 | 3.8 | 2.6 | 3.0 | 35.1 | Y | 10 | 43.2 | 0.25 |

TABLE 2

| Single color | Volume mean particle size (μm) | Particles > 5 μm (number %) | Particles < 1 μm (number %) | Particles of 1.0 to 2.5 μm (number %) | Color | Pigment concentration (%) | aDC | TMA (mg/cm$^2$) |
|---|---|---|---|---|---|---|---|---|
| Comparative Example 1 | 5.7 | 28.4 | 1.8 | 2.3 | M | 6 | 41.0 | 0.45 |
| Comparative Example 2 | 6.1 | 35.5 | 1.4 | 2.0 | K | 4 | 29.3 | 0.45 |
| Comparative Example 3 | 5.8 | 30.5 | 1.7 | 2.2 | C | 6 | 41.8 | 0.45 |
| Comparative Example 4 | 5.9 | 33.4 | 1.7 | 2.9 | Y | 8 | 55.8 | 0.45 |
| Comparative Example 5 | 7.8 | 84.1 | 0.4 | — | M | 4 | 37.4 | 0.65 |
| Comparative Example 6 | 8.2 | 89.2 | 0.3 | — | K | 3 | 29.5 | 0.65 |
| Comparative Example 7 | 7.5 | 80.1 | 0.4 | — | C | 4 | 36.0 | 0.65 |
| Comparative Example 8 | 7.6 | 81.1 | 0.5 | — | Y | 5 | 45.6 | 0.65 |
| Comparative Example 9 | 3.6 | 2.2 | 3.0 | 38.2 | M | 4 | 17.3 | 0.65 |
| Comparative Example 10 | 3.6 | 2.1 | 3.1 | 39.7 | K | 4 | 17.3 | 0.65 |
| Comparative Example 11 | 3.5 | 2.0 | 3.0 | 40.1 | C | 3 | 12.6 | 0.65 |
| Comparative Example 12 | 3.4 | 1.9 | 3.3 | 41.1 | Y | 4 | 16.3 | 0.65 |

In addition, the particle size and the particle size distribution of the particles were measured using a Coal Tar Counter Type TA-11 manufactured by Coal Tar Counter Co. In this case, when the mean particle size of the toner (colored particles) exceeded 5μm, the measurement was carried out using an aperture tube of 100 μm, the toners of 5 μm or smaller were measured changing the aperture diameter to 50 μm, and when the number distribution was the particles of 1 μm or smaller, the measurement was carried out by changing the aperture diameter to 30 μm (about the particle size measurement, same as above in following examples and comparative examples).

Example 1

The fixing apparatus A ("FX A Color", manufactured by FUJI XEROX CO., LTD.) was mounted on a copying machine ("A Color 935", a remodeled machine manufactured by FUJI XEROX CO., LTD.) and an image was formed on a coated paper using the magenta electrostatic latent image developer obtained as described above.

Similarly, the fixing apparatus B shown in FIG. 3 was mounted on the same copying machine and an image was formed on a coated paper using the magenta electrostatic latent image developer obtained as described above.

The specifications of the fixing apparatus A and the fixing apparatus B are shown below.

<Specifications of fixing apparatus A>

Heating roll 121 (diameter 50 mm)
- Core roll: Made of aluminum, diameter 44 mm
- Coated layer: Silicone rubber (inside; thickness 3 mm)/fluororubber (outside: thickness 40 μm, hardness 40 degree)

Press roll 122 (diameter 50 mm)
- Core roll: Made of aluminum, diameter 44 mm
- Coated layer: Fluororubber (thickness 3 mm, hardness 45 degree)

Fixing speed: 160 mm/second

Nip width: 5 mm

Releasing oil: Silicone oil ("FX Color Fuser Oil", made by FUJI XEROX CO., LTD.)

Fixing temperature: 160° C.

<Specifications of fixing apparatus B>

Heating roll 131 (diameter 50 mm)
- Core roll: Made of aluminum, diameter 44 mm
- Coated layer: Silicone rubber (inside; thickness 3 mm)/fluororubber (outside: thickness 40 μm)

Press roll 133 (diameter 15 mm)
- Core roll: Made of aluminum, diameter 44 mm
- Coated layer: Fluororubber (thickness 3 mm)

Driving roll 134 (diameter 16 mm)

Sponge roll 136 (diameter 16 mm)

Endless belt (length 220 mm, made of polyimide)

Fixing speed: 160 mm/second

Nip width: 15 mm

Releasing oil: Silicone oil ("FX Color Fuser Oil", made by FUJI XEROX CO., LTD.)

Fixing temperature: 150° C.

About the images obtained, the following evaluations were carried out and in the fixing apparatus A and the fixing apparatus B, the releasing properties at fixing were also evaluated. Also, in the case of fixing by the fixing apparatus B, each of the images obtained was evaluated as follows. Furthermore, the TMA was measured as shown below. The evaluation results are shown in Table 3.

<Measurement of TMA>

A solid image of an area ratio of 100% was transferred onto a coated paper and the weight of the toner (TMA: $mg/cm^2$) per unit area of the image area was measured. As the practical measurement method, an unfixed solid image of the area of 10 $cm^2$ was formed on a coated paper, the coated paper having formed the unfixed image was weighed, then, after removing the toner on the coated paper by air blowing, the weight of the coated paper only was measured, and TMA was calculated from the weight difference before and after removing the toner.

Evaluation of image:

<Image density>

A solid image having an area ratio of 100% was formed and the image density of the image area was measured using X-Rite 404 (manufactured by X-Rite Co.). The image density of 1.5 or higher was defined as an allowable range. In Table 2, ○ and × have the following meanings.

○: Image density is 1.5 or higher.

×: Image density is lower than 1.5.

<Fine line reproducibility evaluation test>

An image of fine lines was formed on a photoreceptor such that the line width became 50 μm, the image was transferred to a transfer material and fixed. The image of the fine lines of the fixed image on the transfer material was observed at 175 magnifications using V H-6200 Micro High Scope (manufactured by Keyence Corporation). Practical evaluation standards are as follows. In addition, G1 and G2 are allowable ranges.

G1: Fine lines are uniformly embedded by the toner and there is no disturbance at the edge portions.

G2: Fine lines are uniformly embedded by the toner but slight notches are observed at the edge portions.

G3: Fine lines are almost uniformly embedded by the toner but notches are remarkable at the edge portions.

G4: Fine lines are not uniformly embedded by the toner and notches are remarkable at the edge portions.

G5: Fine lines are not uniformly embedded by the toner and notches are very remarkable at the edge portions.

<Evaluation of image gloss uniformity of solid image>

About the images obtained, the difference of gloss in each image and the gloss difference between the image area and the non-image area (coated paper) were visually observed. G1 and G2 were allowable ranges.

G1: No gloss differences in each image and between the image area and the non-image area were observed and the gloss uniformity of the image was very good.

G2: Between the image area and the non-image area, gloss difference was observed a little but no gloss difference in the image was observed, and as the whole image, the gloss uniformity was good.

G3: Gloss differences were observed slightly in the image and between the image area and the non-image and the gloss uniformity of the image was slightly inferior.

G4: Gloss differences were observed in the image and between the image area and the non-image area and the gloss uniformity of the image was inferior.

G5: Severe gloss difference was observed in the image and between the image area and the non-image area and the gloss uniformity of the image was very inferior.

<Evaluation of releasing property at fixing>

The releasing property of a coated paper to the heating roll and the press roll or the endless belt at fixing was evaluated. Practically, attaching of toner to the heating roll the press roll or the endless belt after continuous copying 10,000 copies was visually observed and also the occurring frequency of the rolling in trouble of coated papers to the heating roll and the press roll or the endless belt was determined and evaluated by the following standards. ○ was defined to be an allowable range.

○: The self-stripping property was very good, no paper clogging trouble occurred, and attaching of the toner to the heating roll was not observed.

Δ: The self-stripping property was good and the paper clogging trouble was not occurred but attaching of a very slight amount of the toner to the heating roller was observed.

×: The initial self-stripping property was good but with the increase of printing, a rolling problem to the fixing rolls occurred and attaching of the toner to the heating roll was also observed.

<Evaluation of shear of images>

Fine line portions of fixed image were visually observed and was evaluated by the following standards. In this case, ○ was defined to be the allowable range.

○:No shear of images was observed.

Δ: The shear of images was observed slightly but in practical circumstance, it was the shear in an allowable range.

×: Severe shear of images was observed.

Examples 2 to 12 and Comparative Examples 1 to 12

Using other electrostatic latent image developers prepared, images were formed by the same procedure as in Example 1, each TMA was measured and further the above-described evaluations were carried out. The evaluation results are shown in Table 3 and Table 4.

TABLE 3

| | | Fine line | Gloss uniformity of | Roll-roll fixing apparatus | Roll-belt fixing apparatus | |
|---|---|---|---|---|---|---|
| Single color | Image density | reproducibility | solid image | Releasing property | Releasing property | Shear of images |
| Example 1 | O | G1 | G1 | O | O | O |
| Example 2 | O | G1 | G1 | O | O | O |
| Example 3 | O | G1 | G1 | O | O | O |
| Example 4 | O | G1 | G1 | O | O | O |
| Example 5 | O | *1)G1.5 | *1)G1.5 | O | O | O |
| Example 6 | O | *1)G1.5 | *1)G1.5 | O | O | O |
| Example 7 | O | *1)G1.5 | *1)G1.5 | O | O | O |
| Example 8 | O | *1)G1.5 | *1)G1.5 | O | O | O |
| Example 9 | O | G1 | G1 | O | O | O |
| Example 10 | O | G1 | G1 | O | O | O |
| Example 11 | O | G1 | G1 | O | O | O |
| Example 12 | O | G1 | G1 | O | O | O |

*1): The evaluation result is between G1 and G2.

TABLE 4

| Single color | Image density | Fine line reproducibility | Gloss uniformity of solid image | Roll-roll fixing apparatus Releasing property | Roll-belt fixing apparatus Releasing property | Roll-belt fixing apparatus Shear of images |
|---|---|---|---|---|---|---|
| Comparative Example 1 | O | *2)G2.5 | G2 | O | O | O |
| Comparative Example 2 | O | G3 | *2)G2.5 | O | O | O |
| Comparative Example 3 | O | *2)G2.5 | G2 | O | O | O |
| Comparative Example 4 | O | *2)G2.5 | G2 | O | O | O |
| Comparative Example 5 | O | G4 | *3)G3.5 | Δ | Δ | Δ |
| Comparative Example 6 | O | *4)G4.5 | *3)G3.5 | Δ | Δ | Δ |
| Comparative Example 7 | O | G4 | G3 | Δ | Δ | Δ |
| Comparative Example 8 | O | G4 | G3 | Δ | Δ | Δ |
| Comparative Example 9 | O | G2 | G2 | Δ | Δ | Δ |
| Comparative Example 10 | O | G2 | G2 | Δ | Δ | Δ |
| Comparative Example 11 | O | G2 | *2)G2.5 | Δ | Δ | Δ |
| Comparative Example 12 | O | G2 | G2 | Δ | Δ | Δ |

*2): The evaluation result is between G2 and G3.
*3): The evaluation result is between G3 and G4.
*4): The evaluation result is between G4 and G5.

Then, a fixing apparatus in which a heating roll having a coated layer of a fluororubber (hardness 65 degree) was incorporated (hereinafter referred to as "hard roll fixing apparatus) was mounted on the above-described copying machine and the evaluation of the releasing property at fixing was carried out by the same manner as above. In addition, the specifications of the hard roll fixing apparatus and others were the same as those of the above-described fixing apparatus A.

About the toners used in Examples 1 to 4, image fixing was carried out using the hard roll fixing apparatus. The releasing property was good until copying about 500 copies but after copying exceeding 500 copies, a problem that the coated paper was not released from the heating roll and rolled in the heating roll occurred.

2. Examples of three color image formation:

Three-color images were formed by combining the toners of C, M, and Y (Examples 13 and 14 and Comparative Examples 13 and 14) and the evaluations as described above and the evaluation of the gloss uniformity of pattern images were carried out.

The combinations of the toners, the image quality evaluation results of images, the releasing evaluation results are shown in Table 5. In the table "En" shows "the developer used in Example n" and "Cn" shows "the developer used in Comparative Example n".

<Evaluation of gloss uniformity of pattern images>

About the pattern images, the gloss difference in the image and the gloss difference between the image area and non-image area were visually observed. G1 and G2 were defined as the allowable ranges.

G1: No gloss differences in the image and between the image area and the non-image area were observed and the gloss uniformity of the image was very good.

G2: Gloss difference was observed slightly between the image area and the non-image area but the gloss difference was not observed in the image, and the as the whole image, the gloss uniformity was good.

G3: Gloss differences were observed slightly in the image and between the image area and the non-image and the gloss uniformity of the image was slightly inferior.

G4: Gloss differences were observed in the image and between the image area and the non-image area and the gloss uniformity of the image was inferior.

G5: Severe gloss difference was observed in the image and between the image area and the non-image area and the gloss uniformity of the image was very inferior.

TABLE 5

| Three-color | Combination of toners (colors) | | | TMA (mg/cm$^2$) | Image density | Fine line reproducibility | Gloss uniformity of solid image | Gloss uniformity of pattern image | Roll-roll fixing apparatus Releasing property | Roll-belt fixing apparatus Releasing property | Roll-belt fixing apparatus Shear of images |
|---|---|---|---|---|---|---|---|---|---|---|---|
| Example 13 | E1 (M) | E3 (C) | E4 (Y) | 0.75 | O | *1)G1.5 | G1 | G1 | O | O | O |
| Example 14 | E5 (M) | E7 (C) | E8 (Y) | 1.05 | O | G2 | G2 | G2 | O | O | O |
| Comparative Example 13 | C5 (M) | C7 (C) | C8 (Y) | 1.95 | O | G5 | *3)G4.5 | *3)G4.5 | X | X | X |
| Comparative Example 14 | C9 (M) | C11 (C) | C12 (Y) | 1.95 | O | *2)G2.5 | *2)G2.5 | G4 | X | Δ | Δ |

*1): The evaluation result is between G1 and G2.
*2): The evaluation result is between G2 and G3.
*3): The evaluation result is between G4 and G5.

As described above, the image forming method of this invention has a high reproducibility of fine lines and by the image forming method, a high image quality image having no uneven gloss in the image and between the image area and the non-image area can be formed. Also, by the image forming method of this invention, the occurrences of the offset phenomenon and paper clogging can be restrained and images having a high image quality can be provided with a high stability.

What is claimed is:

1. An image forming method comprising:

developing an electrostatic latent image formed on an electrostatic latent image carrier with a toner containing colored particles comprised of at least a binder resin and a coloring agent to form a toner image;

transferring said toner image to a transfer material to form a transferred image; and fixing the transferred image on the transfer material using a contact-type fixing apparatus, wherein in the fixing, the toner amount in the image region of the image area ratio 100% of the transferred image is 0.40 mg/cm$^2$ or less.

2. An image forming method comprising:

developing an electrostatic latent image formed on an electrostatic latent image carrier with a toner containing colored particles comprised of at least a binder resin and a coloring agent to form a toner image;

transferring said toner image to a transfer material to form a transferred image; and fixing the transferred image on the transfer material using a contact-type fixing apparatus, wherein in the fixing, when the transferred image is the transferred image of a process black formed by three kinds of toners of cyan, magenta, and yellow, the toner amount in the image region of the image area ratio 100% of the image of process black is 1.20 mg/cm$^2$ or less.

3. The image forming method of claim 1, wherein the toner has a volume mean particle size of the colored particles from 1.0 to 5.0 $\mu$m, the colored particles of a particle size of 1.0 $\mu$m or smaller are 20 number % or lower, and the colored particles of a particle size of 5.0 $\mu$m or larger are 10 number % or lower.

4. The image forming method of claim 2, wherein the toner has a volume mean particle size of the colored particles from 1.0 to 5.0 $\mu$m, the colored particles of a particle size of 1.0 $\mu$m or smaller are 20 number % or lower, and the colored particles of a particle size of 5.0 $\mu$m or larger are 10 number % or lower.

5. The image forming method of claim 1, wherein the toner has a volume mean particle size of the colored particles from 2.0 to 5.0 $\mu$m, the colored particles of a particle size of 1.0 $\mu$m or smaller are 20 number % or lower, the colored particles of a particle size of from 1.0 $\mu$m to 2.5 $\mu$m are from 5 to 50 number %, and the colored particles of a particle size of 5.0 $\mu$m or larger are 10 number % or lower.

6. The image forming method of claim 2, wherein the toner has a volume mean particle size of the colored particles from 2.0 to 5.0 $\mu$m, the colored particles of a particle size of 1.0 $\mu$m or smaller are 20 number % or lower, the colored particles of a particle size of from 1.0 $\mu$m to 2.5 $\mu$m are from 5 to 50 number %, and the colored particles of a particle size of 5.0 $\mu$m or larger are 10 number % or lower.

7. The image forming method of claim 1, wherein the color particles are pigment particles and when the concentration of the pigment particles in the colored particles is C (weight %), the true specific gravity of the colored particles is a (g/cm$^3$), and the volume mean particle size of the colored particles is D ($\mu$m), the toner satisfies the relation of following formula (1):

$$25 \leqq a \cdot D \cdot C \leqq 90 \quad (1).$$

8. The image forming method of claim 2, wherein the color particles are pigment particles and when the concentration of the pigment particles in the colored particles is C (weight %), the true specific gravity of the colored particles is a (g/cm$^3$), and the volume mean particle size of the colored particles is D ($\mu$m), the toner satisfies the relation of following formula (1):

$$25 \leqq a \cdot D \cdot C \leqq 90 \quad (1).$$

9. The image forming method of claim 1, wherein the toner further comprises an external additive in which (a) the external additive comprises at least one kind of super fine particles having a primary particle mean particle size of from 30 nm to 200 nm and at least one kind of ultra-super fine particles having a primary particle mean particle size of 5 nm or larger but smaller than 30 nm, and (b) a covering ratio F of the external additive on the surfaces of the colored particles obtained by the following formula (2) is at least 20% for both the super fine particles Fa and the ultra-super fine particles Fb, and the sum total of the covering ratios of the external additives on the surfaces of the colored particles is 100% or lower;

$$F = \sqrt{3} \cdot D \cdot \rho_t \cdot (2\pi \cdot d \cdot \rho_a)^{-1} \cdot C \times 100 \quad (2)$$

wherein F represents a covering ratio (%), D represents a volume mean particle size ($\mu$m) of the colored particles, $\rho_t$ represents a true specific gravity of the colored particles, d represents a primary particle mean particle size ($\mu$m) of the external additive, $\rho_a$ represents a true specific gravity of the external additive, and C represents a ratio (x/y) of the weight x (g) of the external additive to the weight y (g) of the colored particles.

10. The image forming method of claim 2, wherein the toner further comprises an external additive is used, in which (a) the external additive comprises at least one kind of super fine particles having a primary particle mean particle size of from 30 nm to 200 nm and at least one kind of ultra-super fine particles having a primary particle mean particle size of 5 nm or larger but smaller than 30 nm, and (b) a covering ratio F of the external additive on the surfaces of the colored particles obtained by the following formula (2) is at least 20% for both the super fine particles Fa and the ultra-super fine particles Fb and sum total of the covering ratios of the external additives on the surfaces of the colored particles is 100% or lower;

$$F = \sqrt{3} \cdot D \cdot \rho_t \cdot (2\pi \cdot d \cdot \rho_a)^{-1} C \times 100 \quad (2)$$

wherein F represents a covering ratio (%), D represents a volume mean particle size ($\mu$m) of the colored particles, $\rho_t$ represents a true specific gravity of the colored particles, d represents a primary particle mean particle size ($\mu$m) of the external additive, $\rho_a$ represents a true specific gravity of the external additive, and C represents a ratio (x/y) of the weight x (g) of the external additive to the weight y (g) of the colored particles.

11. The image forming method of claim 1, wherein the contact-type fixing apparatus comprises a pair of fixing rolls including a heating roll at least the surface of which is comprised of a rubber elastic body and a press roll at least the surface of which is comprised of a rubber elastic body and which press-contacts with the heating roll, wherein a transfer material having a transferred image formed on the transfer material is passed through a nip region formed by the pair of fixing rolls such that the transferred image is brought into contact with the heating roll to fix the transferred image to the transfer material.

12. The image forming method of claim 2, wherein the contact-type fixing apparatus comprises a pair of fixing rolls including a heating roll at least the surface of which is comprised of a rubber elastic body and a press roll at least the surface of which is comprised of a rubber elastic body and which press-contacts with the heating roll, wherein a transfer material having a transferred image formed on the transfer material is passed through a nip region formed by the pair of fixing rolls such that the transferred image is brought into contact with the heating roll to fix the transferred image to the transfer material.

13. The image forming method of claim 11, wherein the hardness A of the rubber elastic body of the surface of the heating roll and the hardness B of the rubber elastic body of the surface of the press roll satisfy the relation of following formula (3):

$$A \leqq B \quad (3).$$

14. The image forming method of claim 1, wherein the contact-type fixing apparatus comprises a heating roll at least the surface of which is comprised of a rubber elastic body and a belt which is mounted on plural supporting rolls and is press-contacted with the heating roll forming a nip region, wherein a transfer material having a transferred image formed on the transfer material is passed between the heating roll and the belt such that the transferred image is brought into contact with the heating roll to fix the transferred image to the transfer material in the nip region.

15. The image forming method of claim 2, wherein the contact-type fixing apparatus comprises a heating roll at least the surface of which is comprised of a rubber elastic body and a belt which is mounted on plural supporting rolls and is press-contacted with the heating roll forming a nip region, wherein a transfer material having a transferred image formed on the transfer material is passed between the heating roll and the belt such that the transferred image is brought into contact with the heating roll to fix the transferred image to the transfer material in the nip region.

16. The image forming method of claim 10, wherein the contact-type fixing apparatus fixes the transferred image on the transfer material at a fixing speed of from 60 mm/sec to 200 mm/sec.

17. The image forming method of claim 14, wherein the contact-type fixing apparatus fixes the transferred image on the transfer material at a fixing speed of from 60 mm/sec to 200 mm/sec.

18. The image forming method of claim 2, wherein the toner amount in the image region of the image area ratio 100% of the image of process black is 1.05 $mg/cm^2$ or less.

19. The image forming method of claim 1, wherein the toner amount in the image region of the image area ratio 100% of the transferred image is 0.35 $mg/cm^2$ or less.

* * * * *